US005285490A

United States Patent [19]

Bunch et al.

[11] Patent Number: 5,285,490

[45] Date of Patent: Feb. 8, 1994

[54] IMAGING COMBINATION FOR DETECTING SOFT TISSUE ANOMALIES

[75] Inventors: Phillip C. Bunch; Luther C. Roberts, both of Rochester; Kenneth E. Huff, Spencerport; Robert E. Dickerson, Rochester, all of N.Y.

[73] Assignee: Eastman Kodak Company, Rochester, N.Y.

[21] Appl. No.: 14,930

[22] Filed: Feb. 8, 1993

Related U.S. Application Data

[63] Continuation-in-part of Ser. No. 990,499, Dec. 14, 1992, abandoned, which is a continuation-in-part of Ser. No. 964,805, Oct. 22, 1992, abandoned.

[51] Int. Cl.[5] ..... G21K 3/00

[52] U.S. Cl. ..... 378/156; 378/62; 378/185

[58] Field of Search ..... 378/62, 98, 156, 158, 378/182, 185; 250/484.1 B

[56] References Cited

U.S. PATENT DOCUMENTS

| | | | |
|---|---|---|---|
| 3,859,527 | 1/1975 | Luckey | 250/327 |
| 3,860,817 | 1/1975 | Carmean | 378/156 |
| 4,513,078 | 4/1985 | Sandrik et al. | 378/156 |
| 4,843,619 | 6/1989 | Sheridan | 378/207 |
| 4,926,047 | 5/1990 | Takahashi et al. | 250/484.1 B |

OTHER PUBLICATIONS

Raymond Carier and Rénee Béïque, "Analogous Filters for Beam Shaping in Diagnostic Radiology", Phys. Med. Biol., 1992, vol. 37, No. 6, 1313–1320, Printed in the UK.

*Primary Examiner*—David P. Porta
*Attorney, Agent, or Firm*—Carl O. Thomas

[57] ABSTRACT

A radiographic imaging combination that is capable of detecting soft tissue anomalies is described. This combination is particularly effective for neonatal radiography and comprises a source of X-radiation exhibiting a peak emission in the range of from 40 to 60 keV with a 2 mm aluminum equivalent filtration, a filter for the source which comprises tellurium and/or antimony, at least one X-radiation imaging screen.

15 Claims, 3 Drawing Sheets

IMAGING COMBINATION FOR DETECTING SOFT TISSUE ANOMALIES

This is a continuation-in-part of U.S. Ser. No. 990,499, filed Dec. 14, 1992, now abandoned which is in turn a continuation-in-part of U.S. Ser. No. 964,805, filed Oct. 22, 1992, now abandoned.

FIELD OF THE INVENTION

This invention relates to radiographic imaging. More particularly, the invention relates to an imaging combination capable of detecting differences in soft tissue, i.e., soft tissue anomalies, which makes the combination particularly effective in the area of neonatal radiography.

BACKGROUND OF THE INVENTION

In medical radiography, an image of a patient's tissue and bone structure is produced by exposing the patient to X-radiation and recording the pattern of penetrating X-radiation using a radiographic element containing at least one radiation sensitive silver halide emulsion layer coated on a transparent (usually blue-tinted) support. Differences in X-radiation absorption by various body tissue, i.e. subject contrast, result in image-wise differences in silver density in the developed silver image, i.e. radiographic contrast. X-radiation can be directly recorded by the aforementioned emulsion layer where only limited areas of exposure are required, as in imaging of body extremities. However, a more efficient approach which greatly reduces X-radiation exposures, is to employ an imaging screen in combination with the radiographic element. The imaging screen, commonly referred to as an intensifying screen, absorbs X-radiation and emits longer wavelength electromagnetic radiation which silver halide emulsions more readily absorb. Another technique for reducing patient exposure is to coat two silver halide layers on opposite sides of the film support to form a "double-coated" radiographic element. Diagnostic needs can be satisfied at the lowest patient X-radiation exposure levels by employing a double-coated radiographic element in combination with two imaging screens.

A more recently developed approach for radiographic diagnostic imaging is to employ a second type of imaging screen, commonly referred to as a storage phosphor screen, instead of one or two imaging screens of the first type (i.e., intensifying screens) and a radiographic element. This imaging approach was first proposed by Luckey U.S. Pat. No. 3,859,527 (reissued as Re. 31,847). Storage phosphor screens can be essentially similar in construction to X-ray intensifying screens, differing primarily in the composition of the phosphor selected. Storage phosphor screens are imagewise exposed to X-radiation that is again absorbed by the phosphor particles. Although the phosphor may promptly fluoresce to some degree, most of the absorbed X-radiation energy is retained in the phosphor particles. When stimulated with longer wavelength radiation the screen emits in a third wavelength region of the spectrum. Typically an X-ray imaging screen of the storage phosphor type is used alone for imaging. After imagewise exposure it is typically stimulated to emit by scanning, and the emission pattern is stored in computer memory. The image can be viewed as a video display, but more typically a hard copy of the image pattern is produced for careful study by transferring the image information from computer memory to a silver halide radiographic element via laser exposure.

In both approaches image capture by an imaging screen are similar and usually the image that is ultimately produced for close inspection is a silver image produced in a radiographic element. Hence the imaging limitations of both approaches are similar.

An imagewise exposed and processed radiographic element is primarily intended for viewing by transmitted light. In a typical situation a medical radiologist studies the silver image with the radiographic element mounted on a light box, a white translucent illumination source. An accurate diagnosis requires that the silver image accurately differentiate between diseased and healthy tissue which may sometimes be distinguished by differences in silver density, which result from differences in subject contrast. Unfortunately, such density differences are very difficult to detect in soft tissue since such soft tissue anomalies frequently fail to provide sufficient subject contrast such that radiographic contrast within the silver image is sufficient to provide for an accurate diagnosis.

Low subject contrast is a particular problem in neonatal radiography where the bone structure of a newborn infant is not fully developed and it is important to diagnose problems that may occur in areas such as the heart, lungs and intestines, all of which are soft tissue. An example of one such important diagnosis is the detection of hyaline membrane disease that manifests itself as a fine "ground glass" pattern in the lungs. In the absence of sufficient subject contrast, such a pattern can be easily mistaken for and/or obscured by radiographic noise in the film screen system which provides the radiographic silver image. Furthermore, this problem cannot be solved by simply increasing radiographic film contrast because increasing such film contrast increases radiographic noise or mottle which obscures the pattern. Diagnosis of this disease in the very first days of life in a neonate is critical as this condition is life-threatening. Accordingly, an accurate diagnosis of hyaline membrane disease, as well as other diseases, and treatment at an early stage is essential.

The effect on filter efficiency, subject contrast and exposure level or dosage by modifying a diagnostic X-radiation beam with a filter using a water phantom and a detector consisting of a pair of intensifying screens immediately behind the water phantom, is the subject of a computer simulation study based on photon transport calculations reported in an article by Raymond Carrier and René Béïque, "Analogous Filters for Beam Shaping in Diagnostic Radiology", Phys. Med. Biol., 1992, Vol. 37, No. 6, 1313–1320. Printed in the U.K. The article states that the study was limited to filters containing materials having odd-numbered atomic numbers and the conclusions are based upon a calculation involving a large number of such filter materials. No experimental data is provided in the article. Also, there is no indication whether the filter materials were metals or nonmetals or both. However, the report presents these conclusions: (1) "Unpredictable behavior was observed with higher atomic number filter materials in the range of 40 to 70: a small change in any of the parameters changed the efficiency, the contrast and the integral dose. Occasionally the contrast increased within this range of atomic number, but invariably in these cases, the efficiency was very low and the integral dose was high." and (2) "Even with the extensive combinations of parameters used, no magic filter was found which would produce increased contrasts or a decreased integral dose, while maintaining efficiency similar to that of aluminum. Filters of some atomic numbers produced increased contrast, but had negligible efficiency.". The report also sets forth a curve, FIG. 1, which depicts the semi-log plot of the thickness required (kg $m^{-2}$) to produce analogous filters normalized to the thickness of aluminum. This curve shows a hiatus for filter materials having atomic numbers between approximately 45 and 55 which indicates that no suitable filter was found for materials having atomic numbers within this range or that the efficiency of such materials would be insignificant. In light of the teachings of the Carrier et al., article, it is clear that the use of X-radiation source filters to improve subject contrast is both empirical and highly unpredictable. In addition, the data reported in the article, particularly, the aforementioned curve, suggests that filter materials having atomic numbers within the range of 40 to 70 would be unsuitable for this purpose. Also, there is no description of any specific filter material or its use in the system described.

This invention addresses the problem of enhancing the quality of a radiographic image by increasing subject contrast in soft tissue anomalies, particularly soft tissue anomalies which normally exhibit subject contrasts of less than 10 percent. It is evident that it would be desirable to provide an image-forming combination which achieves the aforementioned increased subject contrast without exposing the patient to unacceptable X-radiation exposure levels. This invention meets this objective.

SUMMARY OF THE INVENTION

In one aspect this invention provides an imaging combination for providing improved radiographic images of soft tissue anomalies exhibiting subject contrasts of less than 10 percent, and often less than 5 percent. The combination comprises means for providing a source of X-radiation exhibiting a peak emission in the range of from about 40 to 60 keV with a 2 mm aluminum equivalent filtration, a filter for the source radiation capable of being positioned between the source radiation and the soft tissue and containing at least one of tellurium and antimony, an X-radiation imaging screen that is capable of (a) being positioned to receive X-radiation from the source means after at least a portion of the X-radiation has passed through the soft tissue to thereby provide an image to be detected, and (b) absorbing X-radiation and (c) emitting radiation at a wavelength in the range of about 300 to 700 nm.

In one preferred form of the invention the imaging screen is a storage phosphor screen. In this form of the invention a silver halide radiographic element is typically used at a later stage for producing a permanent image for inspection and study, but the radiographic element is not a part of the imaging combination.

In another preferred form the imaging combination additionally includes a radiographic element that is (a) capable of being positioned adjacent or contiguous to the intensifying screen for exposure by the emitted radiation to thereby detect the image from the screen, and (b) comprising a film support and at least one silver halide emulsion layer unit coated on a major face of the support, and the imaging screen is in this instance an intensifying screen.

In practicing this invention, increased contrast of the silver image is achieved simply by developing the radiographic element using conventional techniques. Such processing can be accomplished using such conventional X-radiation processing techniques as rapid-access X-radiation processing techniques in which processing is completed in 90 seconds or less, as described in greater detail hereinafter. Another advantageous feature of this invention is that the X-radiation filters can be prepared by convenient coating techniques on flexible supports of the type that are conventionally employed in the X-radiation field. After fabrication, the filters can be combined with readily available components, for example, a portable X-radiation source of the type typically employed in neonatal radiography, an X-radiation imaging screen and, optionally, a radiographic element to provide the improved imaging combination of this invention. Furthermore, as illustrated hereinafter, a filter can be fabricated as a composite of several single coatings to provide any desired concentration of tellurium and/or antimony which will give the desired curve shape, as depicted in FIG. 2. It is also significant to note that tellurium and antimony are unique among elements having similar atomic numbers such as tin, cesium and barium as filters for X-radiation, as illustrated in the following Examples. Thus, tellurium and antimony provide results that are clearly unexpected in light of the results achieved with tin, cesium, and barium which are reported in the Table presented hereinafter in the Examples.

DETAILED DESCRIPTION OF THE INVENTION

Figure 1:
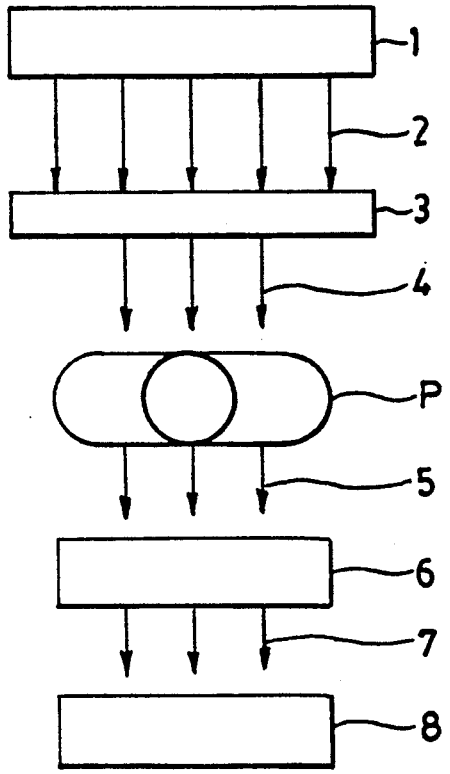
FIG. 1 is a schematic illustration of a radiographic imaging combination in use, according to this invention.

FIG. 1 illustrates a radiographic imaging combination which comprises an X-radiation source 1, exhibiting a peak emission in the range of from about 40 to 60 keV with a 2 mm aluminum equivalent filtration, which transmits X-radiation 2, to a filter 3, comprising tellurium or antimony. Filter 3 acts as a K-edge or bandpass beam filter which reduces high and low energy portions of the X-radiation. Filtered X-radiation 4, passes through the soft tissue of the patient P, and emerges from the patient's body to impinge as incident X-radiation 5, on X-radiation intensifying screen 6. This screen absorbs the incident X-radiation and emits visible radiation 7, having a wavelength in the range of about 300 to 700 nm. Visible radiation 7 exposes a radiographic element 8 which comprises a film support and at least one silver halide emulsion layer unit coated on a major face of the support. The exposed and processed radiographic element describes the configuration of patient soft tissue in terms of a silver image. To simplify the explanation, the X-radiation intensifying screen has been depicted in FIG. 1 as a single screen located some distance from the radiographic element. In practice, the radiation sensitive element is typically positioned adjacent one screen and often between two intensifying screens with each of the screens being in close contact with silver halide emulsion layer units of the radiographic element. This feature is depicted in FIG. 2.

Figure 2:
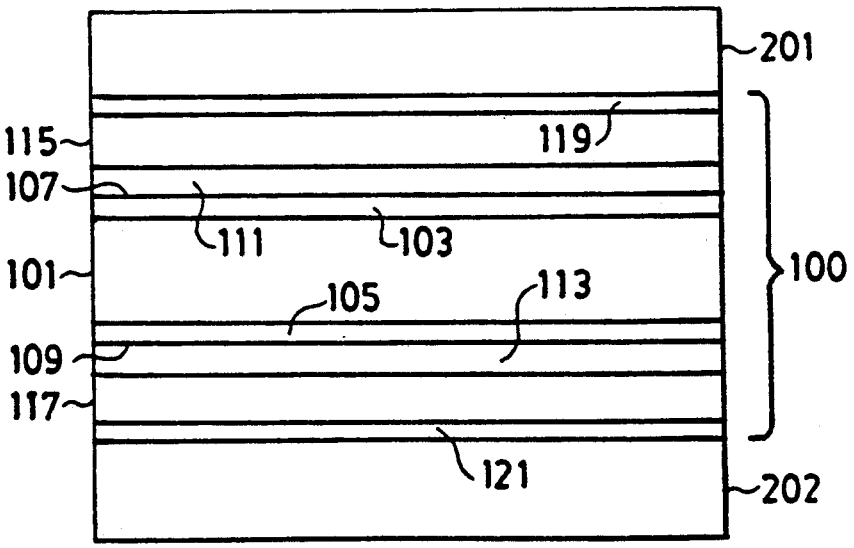
FIG. 2 is a schematic illustration of a preferred radiographic imaging assembly useful in the imaging combination of this invention, which assembly includes both the X-radiation intensifying screen and silver halide emulsion layer unit components of such combination.

FIG. 2 is a more detailed schematic illustration of an imaging assembly comprising the X-radiation intensifying screen and radiographic element components of the imaging combination of this invention. A preferred construction is depicted in which the radiographic element 100 is comprised of a transparent film support 101, typically blue tinted (a customary preference of radiologists), and optional subbing layer units 103 and 105, each of which can be formed of one or more adhesion promoting layers. Optionally, and preferably, the first and second opposed major faces 107 and 109 of the subbing layer units have thereon crossover reducing hydrophilic colloid layers 111 and 113, respectively. Such layers are often used to improve image sharpness and are described in greater detail hereinafter. Overlying the crossover reducing layers 111 and 113 are light recording latent image forming silver halide emulsion layer units 115 and 117, respectively. Overlying the emulsion layer units 115 and 117 are optional protective overcoat layers 119 and 121, respectively. All of the protective layers and hydrophilic colloid layers are permeable to processing solutions. The intensifying screens 201 and 202 are each capable of absorbing X-radiation and emitting electromagnetic radiation at a wavelength of about 300 to 700 nm.

Figure 3:
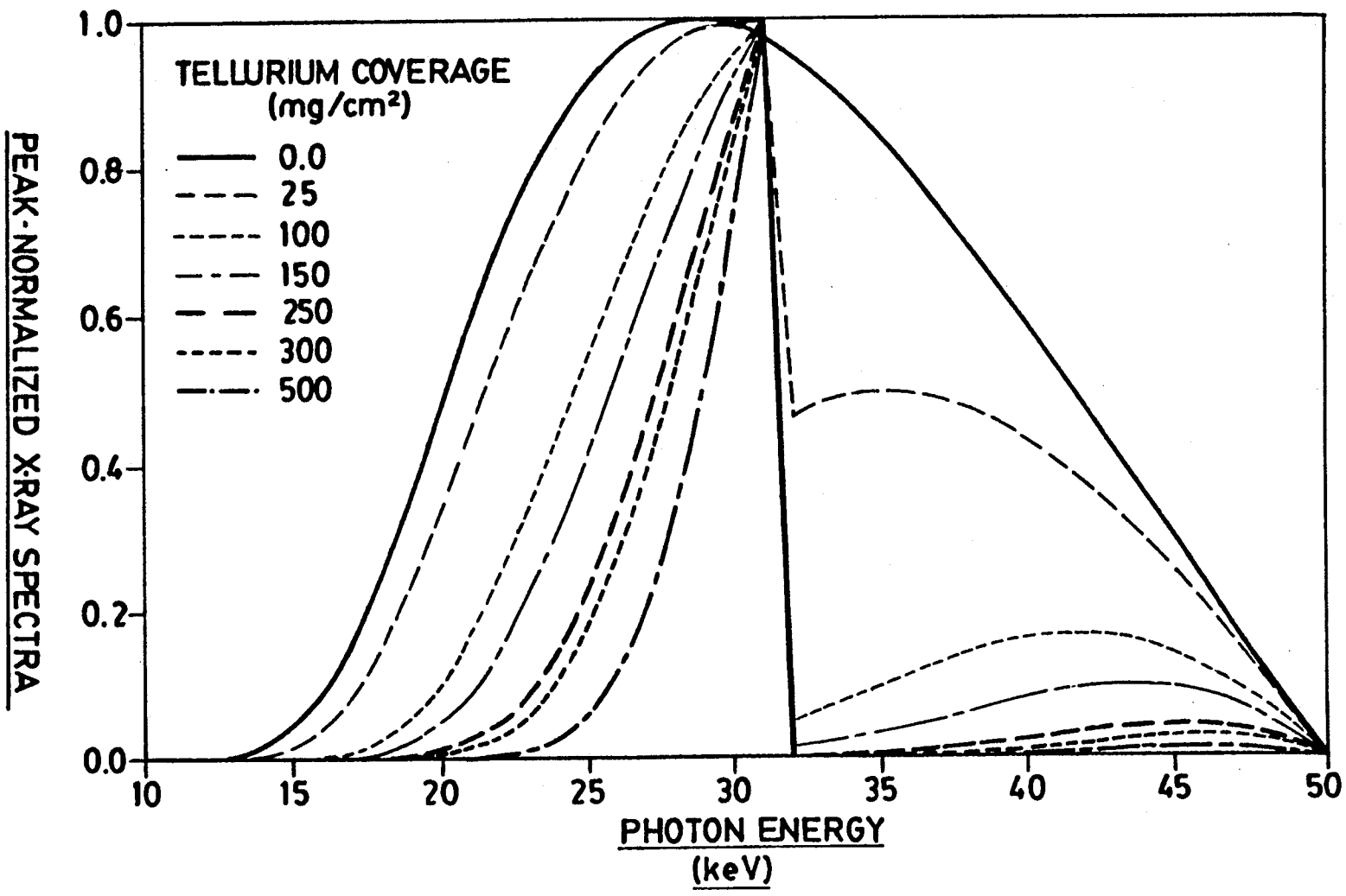
FIG. 3 depicts the X-radiation energy spectra for an X-radiation source filtered using a filter containing varying concentrations of tellurium, according to this invention.
Figure 4:
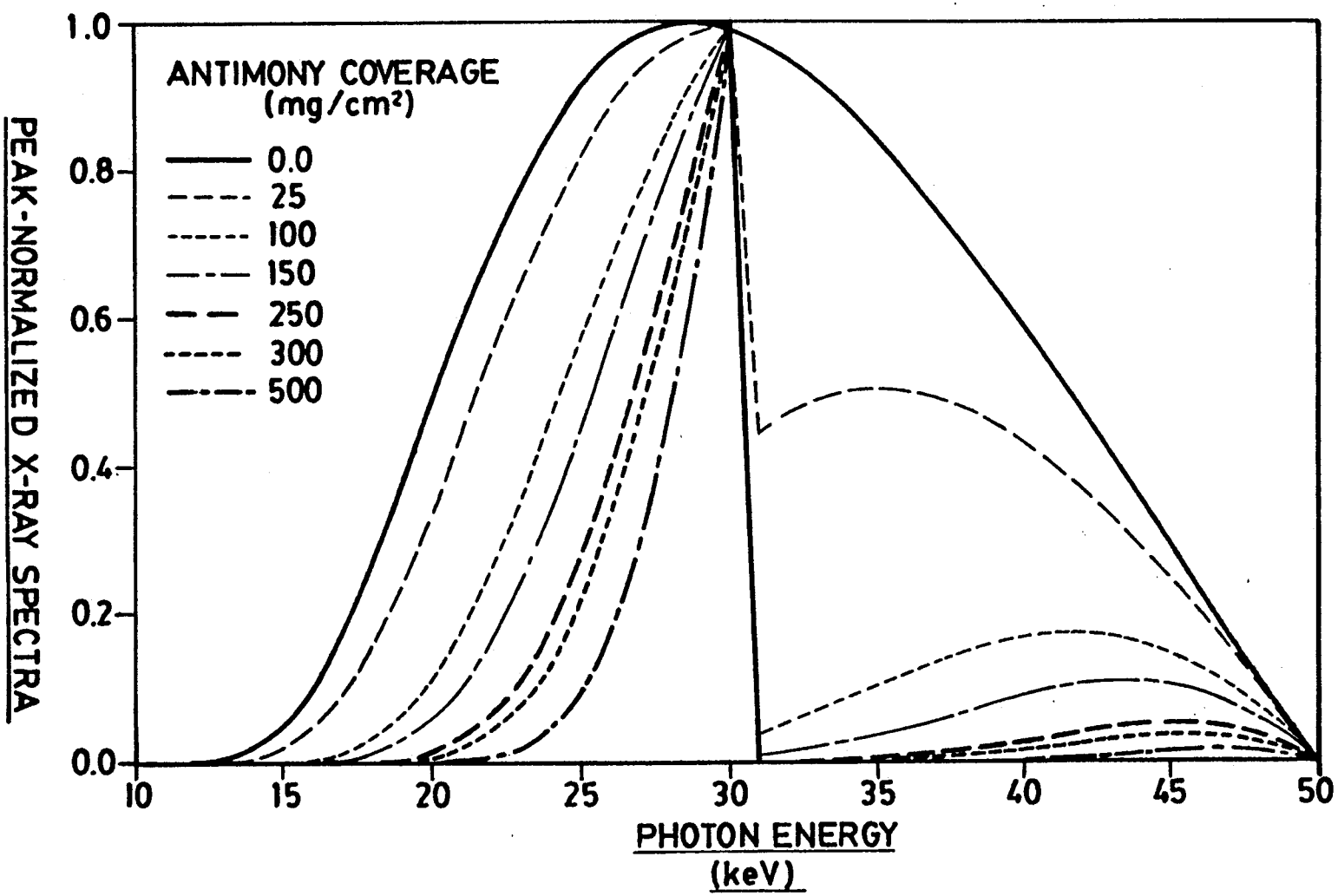
FIG. 4 depicts the X-radiation energy spectra for an X-radiation source filtered using varying concentrations of antimony according to this invention.

FIGS. 3 and 4 illustrate the exit energy spectrum or filtered energy spectra from filters containing varying concentrations of tellurium or antimony, respectively. Such filters are depicted as element 3, in FIG. 1. In FIGS. 3 and 4, the energy spectrum have been normalized to the same maximum value (peak) for ease of interpretation. The source of the X-radiation was a conventional X-radiation tube operated at 50 keV and having an inherent filtration equivalent to 2 mm of aluminum, plus added filtration as indicated. As illustrated by FIGS. 3 and 4, varying the concentrations of tellurium or antimony, expressed as Te or Sb coverage (i.e. the nonmetal or metal elements), from 0 to 500 $mg/cm^2$ results in suppressing both low and high energy portions of the spectrum and transmitting X-radiation having a defined energy level which results in improved differential absorption by soft tissue, i.e. improved subject contrast, and combines with the radiation intensifying screen and radiographic element components of the imaging combination of this invention to markedly improve radiographic contrast of soft tissue anomalies.

The X-radiation source employed in the practice of this invention exhibits a peak emission in the range of from about 40 to 60, often 45 to 55 and preferably 48 to 53 keV with an inherent filtration equivalent to 2 mm aluminum. Suitable X-radiation sources using, for example, tungsten target X-radiation tubes which meet such emission requirements are commercially available. A suitable unit is a General Electric AMX-4 X-radiation unit, available from the General Electric Co. A significant advantage of this invention is that portable low power X-radiation generators of the type typically used in neonatal radiography are available to provide X-radiation having the desired peak emission.

As indicated hereinbefore, the imaging combination of this invention comprises a filter for the source radiation and contains at least one of tellurium and antimony. This filter acts as a K-edge filter which provides K-electron absorption to suppress the radiation energy which reaches the patient. The use of K-edge filters which act as bandpass beam filters for X-radiation energy spectrum are known. See, for example, the Carrier et al., article, supra., and U.S. Pat. No. 4,956,859, issued Sep. 11, 1990. This patent describes a system for analyzing biological structures by photon absorptometry, including a radiation source emitting photons and at least one source filter which operates to reduce the emission of high energy photons, to create a sharp drop-off at the high end of the detected energy spectrum. The system described in U.S. Pat. No. 4,956,859 is directed to detection of bone anomalies and teaches nothing with respect to improving the subject contrast of soft tissue. Furthermore, U.S. Pat. No. 4,956,859 makes no mention of specific components of the imaging combination of this invention which are necessary to provide improved contrast in silver images of soft tissue anomalies exhibiting subject contrasts of less than 10 percent, as described herein.

Filters used in this invention can take any form and can be made using a number of suitable techniques. For example, a suitable organic or inorganic tellurium or antimony compound, i.e. one in which tellurium or antimony is the active X-radiation absorbing element, can be mixed with a solvent solution of polymeric binder to form a coating composition. In general, such coating compositions can be prepared and coated using binders and other ingredients conventionally employed in the radiographic art to form X-radiation intensifying screens. Suitable binders, solvents, mixing techniques, supports, subbing layers and coating techniques for forming such X-radiation intensifying screens that are applicable to forming the filters are generally the same as those that are useful for the preparation of intensifying screens and are described in greater detail hereinafter with respect to the preparation of such screens. Examples of suitable tellurium or antimony compounds that can be coated to form useful filters are sulfates, oxides, nitrates, and other tellurium or antimony compounds in which the anions do not significantly absorb X-radiation. Preferred binders that can be employed in preparing the filters are polyurethanes such as those commercially available under the trademark PERMUTHANE from the Permuthane Division of Beatrice Foods Company. Suitable organic solvents useful for forming polymeric binder solutions of the tellurium or antimony compounds can be selected from a wide variety of organic solvents including alcohols such as methanol and halogenated hydrocarbons such as dichloromethane as well as mixtures thereof. The essential feature of the filters employed in the practice of this invention is the presence of tellurium and/or antimony which serve as K-edge or bandpass beam filters for the X-radiation source. In such filters the active source X-radiation absorbing element consists essentially of tellurium or antimony or mixtures thereof. These filters exhibit a K-absorption edge at approximately 31.8 keV and 30.5 keV, for tellurium and antimony, respectively. Typically, the concentration of the tellurium or antimony (alone or in combination) in the filter is in the range of about 25 to 500, often 100 to 300, and preferably 150 to 250 $mg/cm^2$, based on the element. As illustrated in the following Examples, suitable concentrations can be conveniently achieved by using composite filters comprising several elements that are stacked to provide a suitable concentration of tellurium and/or antimony.

Like the filters employed in practicing this invention, the intensifying screens can take any convenient conventional form. However, to obtain the sharpest possible images it is generally preferred to select phosphors for construction of a single screen and, preferably, for both screens (conventionally referred to as front and back screens with respect to the direction of the X-radiation source) where a pair of screens is used as depicted in FIG. 2, that produce satisfactory levels of light emission with the thinnest possible fluorescent layer thicknesses. In one specifically preferred form each intensifying screen includes a fluorescent layer comprised of a phosphor chosen from rare earth oxychalcogenide and halide phosphors of the formula:

$$M_{(w-n)}M'_nO_wX$$

wherein:

M is at least one of the metals yttrium, lanthanum, gadolinium, or lutetium,

M' is at least one of the rare earth metals dysprosium, erbium, europium, holmium, neodymium, praseodymium, samarium, terbium, thulium, or ytterbium, X is a middle chalcogen (S, Se, or Te) or halogen, n is 0.0002 to 0.2, and w is 1 when X is halogen or 2 when X is chalcogen.

Other specifically preferred phosphors include calcium tungstate, non-activated yttrium tantalate, niobium-activated or thulium-activated yttrium tantalate, and terbium-activated gadolinium or lutetium oxysulfide.

Calcium tungstate phosphors are illustrated by Wynd et al in U.S. Pat. No. 2,303,942. Niobium-activated and rare earth activated yttrium, lutetium and gadolinium tantalates are disclosed by Brixner in U.S. Pat. No. 4,225,653. Rare earth activated gadolinium and yttrium middle chalcogen phosphors are taught by Royce in U.S. Pat. No.3,418,246. Rare earth activated lanthanum and lutetium middle chalcogen phosphors are illustrated by Yocom in U.S. Pat. No. 3,418,247. Terbium-activated lanthanium, gadolinium and lutetium oxysulfide phosphors are disclosed by Buchanan et al in U.S. Pat. No. 3,725,704. Cerium activated lanthanum oxychloride phosphors are taught by Swindells in U.S. Pat. No. 2,729,604. Terbium activated and optionally cerium activated lanthanum and gadolinium oxyhalide phosphors are disclosed by Rabatin in U.S. Pat. No. 3,617,743 and Ferri et al in U.S. Pat. No. 3,974,389. Rare earth activated rare earth oxyhalide phosphors are disclosed by Rabatin in U.S. Pat. Nos. 3,591,516 and 3,607,770. Terbium activated and ytterbium activated rare earth oxyhalide phosphors are disclosed by Rabatin in U.S. Pat. No. 3,666,676. Thulium activated lanthanum oxychloride or oxybromide phosphors are illustrated by Rabatin in U.S. Pat. No. 3,795,814. A $(Y,Gd)_2O_2S$:Tb phosphor wherein the ratio of yttrium to gadolinium is between 93:7 and 97:3 is illustrated by Yale in U.S. Pat. No. 4,405,691. Non-rare earth coactivators can be employed as illustrated by bismuth and ytterbium activated lanthanum oxychloride phosphors disclosed by Luckey et al in U.S. Pat. No. 4,311,487. The mixing of phosphors as well as the coating of phosphors in separate layers of the same screen are specifically recognized. A phosphor mixture of calcium tungstate and yttrium tantalate is disclosed by Patten in U.S. Pat. No. 4,387,141. However, in general neither mixtures nor multiple phosphor layers within a single screen are preferred or required.

While it is recognized that the phosphor layers need not contain separate binders, in most applications the phosphor layers contain sufficient binder to provide structural coherence to the phosphor layer. In general, the binders useful in the practice of the invention are those conventionally employed in the art. Binders are generally chosen from a wide variety of known polymers which are transparent to X-radiation and emitted light. Binders commonly employed in the art include sodium o-sulfobenzaldehyde acetal of poly(vinyl alcohol), chlorosulfonated polyethylene; a mixture of macromolecular bisphenol polycarbonates and copolymers comprising bisphenol carbonates and poly(alkylene oxides); aqueous ethanol soluble nylons; poly(alkyl acrylates and methacrylates) and copolymers of poly(alkyl acrylates and methacrylates) with acrylic and methacrylic acids; poly(vinyl butyryl); and polyester or polyurethane elastomers. These and other useful binders are disclosed in U.S. Pat. Nos. 2,502,529; 2,887,379; 3,617,285; 3,300,310; 3,300,311 and 3,743,833, and in Research Disclosure, Vol. 154, February, 1977, Item 15444, and Vol. 182, June, 1979. Research Disclosure is published by Kenneth Mason Publications, Ltd., Emsworth, Hampshire P010 7DD, England. Particularly preferred binders are polyurethanes, such as those coexnercially available under the trademark ESTANE from Goodrich Chemical Co., and under the trademark PERMUTHANE from the Permuthane Division of Beatrice Foods Co.

While a wide range of phosphor to binder ratios can be employed, generally thinner phosphor layers and sharper images are realized when a high weight ratio of phosphor to binder is employed. Preferred phosphor to binder ratios are in the range of from about 10:1 to 25:1 for screen constructions intended to equal commercial screen exposure repetitions without loss of structural integrity. For limited or single exposure applications it is, of course, appreciated that any minimal amount of binder consistent with structural integrity is satisfactory.

In those instances in which it is desired to reduce the effective thickness of a phosphor layer below its actual thickness (thereby enhancing sharpness) the phosphor layer is modified to impart a small, but significant degree of light absorption. If the binder is chosen to exhibit the desired degree of light absorption, then no other ingredient of the phosphor layer is required to perform the light attenuation function. For example, a slightly yellow transparent polymer will absorb a significant fraction of phosphor emitted blue light. U/V absorption can be similarly achieved. It is specifically noted that the less structurally complex chromophores for U/V absorption particularly lend themselves to incorporation in polymers.

In most instances a separate absorber is incorporated in the phosphor layer to reduce its effective thickness. The absorber can be a dye or pigment capable of absorbing light within the spectrum emitted by the phosphor. Yellow dye or pigment selectively absorbs blue light emissions and is particularly useful with a blue emitting phosphor. On the other hand, a green emitting phosphor is better used in combination with magenta dyes and pigments. U/V emitting phosphors can be used with known U/V absorbers. Black dyes and pigments are, of course, generally useful with phosphors because of their broad absorption spectra. Carbon black is a preferred absorber.

The patents cited hereinbefore for phosphor teachings also disclose useful intensifying screen constructions. Screen supports are most commonly film supports of high dimensional integrity, and include poly(ethylene terephthalate) film supports, for example. For best image definition, when the screen support and subbing and anticurl layers are transparent, the phosphor layer contains an absorber or a black surface is positioned adjacent the anticurl layer during exposure. For example, a black polyvinyl chloride or paper sheet can be positioned adjacent the anticurl layer. If desired to increase speed, screen supports and/or their subbing or anticurl layers can be reflective of emitted light. For example, a blue or white back screen support can be chosen to reflect light emitted by calcium tungstate or rare earth-activated yttrium tantalate or a green or white support can be chosen to reflect light emitted from a rare earth-activated lutetium gadolinium oxysulfide phosphor. Titania or barium sulfate is preferably coated on or incorporated in screen supports to maximize reflection of green light. Metal layers such as aluminum can be used to enhance reflection. Paper supports, though less common for intensifying screens than film supports, are known and can be used for specific applications.

Dyes and pigments are commonly loaded into supports to enhance absorption or reflection of light. Air can be trapped in supports to reflect U/V light. Intensifying screen supports and the subbing layers used to improve coating adhesion can be chosen from among those employed for silver halide photographic and radiographic elements, as illustrated by Research Disclosure, Vol. 176, Dec. 1978, Item 17643, Section XVII, and Research Disclosure, Vol. 184, Aug. 1979, Item 18431, Section I, the disclosures of which are hereby incorporated by reference herein.

An overcoat, though not required, is commonly located over the phosphor layer for humidity and wear protection. The overcoat can be chosen using the criteria described hereinbefore in connection with the binder. The overcoat can be chosen from among the same polymers used to form either the screen binder or the support, with the requirements of toughness and scratch resistance usually favoring polymers conventionally employed for film supports. For example, cellulose acetate is a preferred overcoat used with the preferred polyurethane binders. Overcoat polymers are often used to also seal the edges of the phosphor layer.

While anticurl layers are not required for the intensifying screens, they are generally preferred for inclusion. The function of the anticurl layer is to balance the forces exerted by the layers coated on the opposite major surface of the screen support which if left unchecked, cause the screen to assume a nonplanar configuration, e.g. to curl or roll-up on itself. Materials forming the anticurl layers can be chosen from among those identified above for use as binders and overcoats. Generally, an anticurl layer is formed from the same polymer as the overcoat on the opposite side of the support. For example, cellulose acetate is preferred for both overcoat and anticurl layers.

To prevent blocking, particularly adhesion of the radiographic element and intensifying screens, the overcoats of the phosphor layers can include a matting agent, although such layers are more commonly employed in radiographic elements then with screens. Useful matting agents can be selected from those cited by Research Disclosure, Item 308119, Dec. 1989, Section XVI. A variety of other optional materials can be included in the surface coatings of the intensifying screens, such as materials to reduce static electrical charge accumulation, plasticizers, lubricants, and the like. However, such materials are more commonly included in the radiographic elements which come into contact with the intensifying screens.

The radiographic elements forming a part of the imaging combination of this invention comprise a film support and at least one silver halide emulsion layer unit coated on a major face, typically each major face, of the support. Such radiographic elements are combined with an appropriate number of screens to form an imaging assembly; a typical assembly being depicted in FIG. 2. When emulsion layer units are coated on each major face of the support (so-called double-coated radiographic elements), such emulsion layer units can be conveniently referred to as front and back emulsion layer units with the front unit facing in the direction of the X-radiation source. Suitable silver halide emulsion layer units can comprise silver halides such as silver bromide, silver chloride or silver iodide emulsions, or silver chlorobromide, silver chloroiodide, silver bromoiodide, silver chlorobromoiodide emulsions of varying silver halide ratios and mixtures thereof, and can be prepared as described in Research Disclosure, Item 18431, Section IA and B.

In a preferred embodiment of this invention, radiographic elements forming a part of the imaging combination of this invention contain front and back emulsion layer units that comprise at least one high tabularity silver halide emulsion. Such "high tabularity emulsions" were first described by Abbott et al., U.S. Pat. Nos. 4,425,425 and 4,425,426. High tabularity emulsions are those in which tabular grains account for greater than 50 percent of total grain projected area and which satisfy the relationship:

$$ECD/t^2 > 25$$

where

ECD represents the equivalent circular diameter of the tabular grains in micrometers (μm) and t represents the thickness of the tabular grains in μm.

Typically, tabularities range from 40 to 1000, although both higher and lower tabularities can be employed to advantage. Specifically preferred tabular grain emulsions are those in which greater than 50 percent, preferably at least 70 percent and optimally at least 90 percent of the total grain population is accounted for by tabular grains having a thickness of less than 0.3 μm and preferably less than 0.2 μm. The tabular grain emulsions are contemplated to have average aspect ratios (ECD/t) of at least 5 and preferably at least 8. Any conventional tabular grain emulsion satisfying these criteria can be employed, but for radiographic applications it is generally preferred to limit iodide concentrations to less than 5 mole percent, optimally less than 3 mole percent, based on total silver.

The presence of high tabularity silver halide emulsions in dual coated radiographic elements can be used in combination with spectral sensitizing dyes adsorbed to the surfaces of the tabular grains to reduce crossover. Crossover is the term used to indicate exposure by an intensifying screen of the silver halide emulsion layer unit on the opposite side of a support. When the light emitted by a front screen, for example, is not absorbed by the adjacent front emulsion layer unit and passes through to be absorbed by the back emulsion layer unit, the longer light transmission path permits a larger lateral offset between the point of X-radiation absorption and the point of light absorption by the back emulsion layer unit than would have occurred if absorption had occurred in the front emulsion layer unit. This larger lateral offset reduces image sharpness. Any conventional spectral sensitizing dye can be incorporated in an emulsion layer unit that is capable of absorbing light of a wavelength emitted by the intensifying screen with which it is paired. Generally the spectrally sensitizing dye is chosen to exhibit a peak absorption as absorbed to the silver halide grain surfaces that closely matches the peak emission wavelength of the intensifying screen. An extensive listing of useful spectral sensitizing dyes for tabular grain emulsions is provided by Kofron et al U.S. Pat. No. 4,439,520, the disclosure of which is here incorporated by reference.

Any conventional dual-coated radiographic element exhibiting low crossover, i.e. less than 10 percent, can be employed in the radiographic elements used in this invention. This means simply that of the light emitted by one intensifying screen adjacent one emulsion layer unit less than 10 percent reaches the emulsion layer unit on the opposite side of the support. Preferred dual coated radiographic elements are those that exhibit crossover of less than 5 percent and, optimally, no measurable crossover. Techniques for crossover measurement are disclosed in Abbott et al U.S. Pat. Nos. 4,425,425 and 4,425,426, the disclosures of which are here incorporated by reference.

Low crossover is preferably achieved by incorporating at least one crossover reducing layer between the support and an overlying emulsion layer unit in a radiographic element. In the radiographic element 100 depicted in FIG. 2, preferred forms of the crossover reducing layers 111 and 113 are those disclosed by Dickerson et al U.S. Pat. Nos. 4,803,150 and 4,900,652, here incorporated by reference. As therein disclosed, microcrystalline dyes capable of being decolorized during processing can be incorporated in hydrophilic colloid binders to form the crossover reducing layers. To permit rapid processing (processing in less than 90 seconds) it is preferred to limit the hydrophilic colloid content of the crossover reducing layers to less than 65 $mg/dm^2$. Another technique for crossover reduction useful with blue emitting intensifying screens is to incorporate $\beta$ phase silver iodide particles in the crossover reducing layers, as taught by Daubendiek et al U.S. Pat. No. 4,639,411.

It has been recently recognized that imaging advantages can be realized by constructing low crossover dual coated radiographic elements with asymmetrical emulsion layer units. In such elements the silver halide emulsion layer unit coated on one face of the support exhibits a lower average contrast than the silver halide layer unit coated on the other face. Dickerson et al, U.S. Pat. No. 4,994,355, here incorporated by reference, demonstrates medical application advantages for such radiographic elements constructed with a first emulsion layer unit exhibiting a contrast of less than 2.0 and a second emulsion layer unit exhibiting a contrast of at least 2.5. Both contrasts were based on measurements at 0.25 and 2.0 above minimum density and with the first and second emulsion layer units each being coated on both sides of a transparent support, thereby allowing contrasts to be measured in a manner comparable to contrast measurements on symmetrical radiographic elements. Dickerson et al U.S. Pat. No. 4,997,750, here incorporated by reference, demonstrates increased flexibility in imaging to result from constructing dual coated low crossover radiographic elements with emulsion layer units on opposite sides of the support that differ in speed as well as contrast. For example, one emulsion layer unit may be a high speed low contrast unit, while the other is a slower speed higher contrast unit. Specifically, at a density of 1.0 above minimum density the speed of one emulsion layer unit is advantageously increased to at least twice that of the remaining emulsion layer unit. Again, as in the case of the asymmetrical contrast emulsion layer units, speed measurements of each emulsion layer unit are based on symmetrical coatings on both sides of a support. Speed differences of from 2 to 10 times are contemplated with speed differences of from 2 to 4 times being preferred.

Bunch et al, U.S. Pat. No. 5,021,327, here incorporated by reference, discloses extending asymmetry of the radiographic imaging assembly beyond asymmetry in the dual coated low crossover radiographic elements to differences in the photicity of the front emulsion layer unit and front screen as compared to the photicity of the back emulsion layer unit and back screen. Specifically, Bunch et al discloses that improvements in detective quantum efficiencies (DQE), the ratio of input noise to output noise, can be improved by increasing the photicity of the back portion of the assembly to at least twice (preferably from 2 to 10 times) that of the front portion of the assembly. As explained by Bunch et al, photicity is the integrated product of (1) the total emission of the screen over the wavelength range to which the emulsion layer is responsive, (2) the sensitivity of the emulsion layer unit over this emission range, and (3) the transmittance of radiation between the screen and the adjacent emulsion layer unit over this emission range. Transmittance is typically near unity and can in this instance be ignored. Photicity is discussed in greater detail in Mees, The Theory of the Photographic process, 3rd Ed., Macmillan, 1966, at page 462. From the above definition of photicity it is apparent that the desired asymmetry in photicity can be realized with asymmetrical emulsion layer unit selections, asymmetrical screen selections or a combination thereof.

In fact, any one or combination of speed, contrast and photicity can be varied to achieve specific imaging advantages. Dickerson et al, U.S. Pat. No. 5,041,364, and Dickerson et al, U.S. Ser. No. 746,687, filed Aug. 16, 1991 abandoned in favor of U.S. Ser. No. 14,607, filed Feb. 8, 1993, commonly assigned, both disclose different asymmetrical speed and contrast selections to better serve specific medical diagnostic needs.

Following exposure to produce a stored latent image the radiographic element is removed from association with the intensifying screen(s) and preferably processed in a rapid access processor, such as an RP-X-Omat TM processor, which is capable of producing an image bearing radiographic element dry to the touch in less than 90 seconds. Rapid access processors are disclosed by Barnes et al, U.S. Pat. No. 3,545,971 and Akio et al published European Patent Application 248,390, the disclosures of which are here incorporated by reference.

Since rapid access processors employed commercially vary in their specific processing cycles and selection of processing solutions, the preferred radiographic elements satisfying the requirements of the present invention are specifically identified as being those which are capable of emerging dry to the touch when processed in 90 seconds according to the following reference conditions:

| | |
|---|---|
| development | 24 seconds at 35° C., |
| fixing | 20 seconds at 35° C., |
| washing | 10 seconds at 35° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Whater to 1 liter at pH 10.0, and the fixing step employs the following fixing composition:

| | |
|---|---|
| Ammonium thiosulfate 60% | 260.0 g |
| Sodium bisulfate | 180.0 g |
| Boric acid | 25.0 g |
| Acetic acid | 10.0 g |
| Aluminum sulfate | 8.0 g |

Water to 1 liter at pH 3.9 to 4.5.

In the foregoing description an imaging combination has been described in which the X-radiation imaging screen is an intensifying screen employed in combination with a silver halide radiogrpahic element. It is alternatively contemplated to employ as the X-radiation imaging screen a storage phosphor screen. In th is form of the invention no radiographic element is employed at he time of patient exposure. Referring to FIG. 1, the same arrangement is employed as shown, except that 6 represents a storage phosphor screen and the radiographic element 8 is absent.

The storage phosphor screen absorbs X-radiation in exactly the same manner as the intensifying screen. The difference is that, whereas an intensifying screen promptly emits radiation in the wavelength region of from 300 to 700 nm, the storage phosphor screen is relied upon to internally storage the absorbed image pattern and to emit in the visible wavelength region only with subsequently stimulated.

Except for the phosphors selected, the construction of the storage phosphor screen is essentially similar to that of the intensifying screens disclosed above. When the X-ray imaging screens are intended to used as storage phosphor screens, the particulate phosphors can take any of the forms disclosed by Luckey U.S. Pat. No. 3,859,527 (reissued as Re. 31,847), cited above and here incorporated by reference. Preferred stimulable storage phosphors are rare earth activated barium fluorohalide phosphors Exemplary phosphors of this type are disclosed by U.K. Patent 1,419,169, Ferretti U.S. Pat. Nos. 4,080,306 and 4,524,071, Aoki et al U.S. Pat. No. 4,109,152, Mori et al U.S. Pat. No. 4,138,529, Kotera et al U.S. Pat. Nos. 4,239,968, 4,261,854, 4,258,264, 4,239,968, 4,512,911, 4,889,996 and 4,978,472, Takahashi et al U.S. Pat. Nos. 4,368,390, 4,380,702, 4,394,581, 4,535,237, 4,535,238, 4,876,161, 4,894,548, 4,895,772, and 4,926,047, Nishimora et al U.S. Pat. No. 4,336,154, Nakamura et al U.S. Pat. Nos. 4,532,071, 4,605,861, 4,698,508, 4,835,398 and 4,891,227, Umemoto et al U.S. Pat. No. 4,505,889, Takahara et al U.S. Pat. No. 4,515,706, Arakawa et al U.S. Pat. No. 4,534,884, Miyahara et U.S. Pat. No. 4,539,138, Degenhardt U.S. Pat. No. 4,587,036, and Katoh et al U.S. Pat. No. 4,871,474. Other stimulable storage phosphor compositions are, of course, known, as illustrated by Ackerman U.S. Pat. No. 4,496,844. All of the patents cited above are here incorporated by reference, primarily for their disclosure of storage phosphors, but also for their overall disclosure of storage phosphor screen constructions, stimulation spectra and emission spectra.

As can be readily appreciated the ranges of optimum stimulation and emission spectra are a function of the specific storage phosphor selected. It is generally preferred to select storage phosphors that provide useful stimulated emissions in the wavelength range of from 300 to 700 nm, although emission within any conveniently photodetected wavelength range can be utilized.

In a specifically preferred form the storage phosphors are europium activated barium fluorohalide phosphors, most preferably europium activated barium fluorobromide phosphors. Kotera et al U.S. Pat. No. 4,258,264 and Takahashi et al U.S. Pat. Nos. 4,535,237 and 4,535,238 collectively disclose stimulation of these phosphors in the wavelength range of from 400 to 800 nm and collectively disclose useful emissions in the wavelength range of from 300 to 700 nm.

A specifically preferred europium activated barium fluorobromide storage phosphor composition satisfies the formula:

$$BaF_xBr_y:Eu_pCa_qNa_r(SiO_2)_s(I)$$

where x is 1.0 to 1.1;

y is 1.0 to 0.9;

p is $7\times10^{-4}$ to $1.3\times10^{-3}$;

q is $1\times10^{-2}$ to $1\times10^{-3}$;

r is $1\times10^{-4}$ to $2\times10^{-3}$; and s is $5\times10^{-3}$ to $5\times10^{-3}$.

The following Examples are presented to further illustrate the invention.

EXAMPLES

The following filters were employed. Of these filters, B, B', C and C' are of the invention while A, A', D, D', E, E', F and F' are used for comparison purposes.

INTENSIFYING SCREEN EXAMPLES

FILTER A

A 143 gm sample of tin oxide was dispersed in 92 gm of a solution of PERMUTHANE polyurethane binder at 13 percent solids in 93:7 dichloromethane/methanol, by stirring. Final dispersion was accomplished by milling in an attriter with 156 gm of 0.8 to 1.0 mm zirconia/silica beads, removing the beads by filtration, adding another 20 gm of PERMUTHANE polyurethane binder solution with stirring, and concentrating at reduced pressure until adequate coating viscosity was reached. The dispersion was coated on 178 μm thick poly(ethylene terephthalate) support. Coatings were prepared at coverages of approximately 24.0, 40.4, 48.3, 49.6, 50.2, 55.3, and 56.4 mg/cm$^2$ tin. Each coating was allowed to dry on a tempered block until it was dry to the touch, given a final drying in an oven at 50° C. and then overcoated with a 20 percent solution of poly(vinylidene fluoride), available as KYNAR 7201 from Elf Atochem N. A., in acetone. Several of the coatings were stacked together to provide a composite filter with a coverage of 220 mg/cm$^2$ tin. This concentration was selected as a matter of convenience since it could be achieved simply by combining several of the aforementioned available coatings.

FILTER B

A 300 gm sample of tellurium oxide ($TeO_2$), 99.9995 percent pure (metals basis), was ground by ball-milling in a 1 liter polyethylene jar with 450 gm of 6.35 mm cylinders until the powder contained only particles less than 10 μm in diameter. About 275 gm of the powder was stirred into 212 gm of a solution of PERMUTHANE polyurethane binder at 13 percent solids in 93:7 dichloromethane/methanol. The mixture was dispersed by milling in an attriter with 280 gm of 0.8 to 1.0 mm zirconia/silica beads. After removing the beads by filtration, the dispersion was concentrated at reduced pressure until adequate coating viscosity was reached. The dispersion was coated on 178 μm thick poly(ethylene terephthalate) to give approximately 45.6 mg/cm$^2$ of tellurium. An overcoat was applied as for FILTER A. The appropriate number of layers were stacked together to give 230 mg/cm$^2$ tellurium.

FILTER C

A 300 gm sample of antimony oxide ($Sb_2O_3$), 99.999 percent pure (metals basis), was ball-milled in a 1 liter polyethylene jar with 450 gm of 6.35 mm cylinders until the maximum particle diameter was reduced to less than 10 μm. About 275 gm of the powder was dispersed in 211 gm of a solution of PERMUTHANE polyurethane binder at 13 percent solids in 93:7 dichloromethane/methanol by stirring. Coatings were made as for FILTER A, with coverages of about 41.0, 42.4, 47.6, and 49.3 mg/cm$^2$ antimony. Overcoats were applied as for FILTER A. An appropriate number of coatings were stacked together to give 230 mg/cm$^2$ antimony.

FILTER D

A 200 gm sample of cesium sulfate ($Cs_2SO_4$), 99.99 percent pure (metals basis), was ground while wet with isopropyl alcohol, until most of the particles were below 100 μm in diameter. The powder was then ball-milled with 500 gm of 6.35 mm cylinders and 78 gm of 12.7 mm cylinders until the particle diameters were below 40 μm. The powder was then dispersed in a solution of PERMUTHANE polyurethane binder at 13 percent solids in 93:7 dichloromethane/methanol. Dispersion was completed by milling in an attriter with 200 gm of 0.8 to 1.0 mm zirconia/silica beads. The final dispersion was coated as for FILTER A, at coverages of about 31.6, 38.9, and 44.6 mg/cm$^2$ cesium. an overcoat was applied as in FILTER A. An appropriate number of coatings were stacked together to give 230 mg/cm$^2$ of cesium.

FILTER E

Coatings were prepared with barium sulfate ($BaSO_4$), 97.9 percent (less than 10 ppm heavy metals contamination). To prepare the coating dispersion, 50 kg of the barium sulfate was mixed with 58.2 kg of a solution of PERMUTHANE polyurethane binder at 12.2 percent solids in 93:7 dichloromethane/methanol, followed by sufficient agitation. A coating was prepared on 178 μm thick poly(ethylene terephthalate) at a coverage of 25.5 mg/cm$^2$ barium. An overcoat was applied from a solution of cellulose acetate. An appropriate number of coatings were stacked together to give 230 mg/cm$^2$ barium.

FILTER F

A layer of aluminum foil having a thickness of 2 mm.

The following intensifying screen was employed in the invention.

SCREEN

The screen was a conventional medium resolution screen. It consisted of a terbium activated gadolinium oxysulfide phosphor having a median particle size of 7 μm coated on a white pigmented polyester support in a PERMUTHANE polyurethane binder at a total phosphor coverage of 5.9 g/dm2 at a phosphor to binder ratio of 15:1 and containing 0.01384 percent, by weight, of a 152:1 weight ratio of a yellow dye and carbon.

RADIOGRAPHIC ELEMENT

The radiographic element employed was a double-coated element constructed on a blue tinted transparent polyester film support. Both sides of the support were coated with green-sensitized silver bromide emulsions comprising tabular grains having a thickness of less than 0.3 μm and an average aspect ratio (ECD/t) greater than 8. Each emulsion was a blend of three emulsions wherein the first emulsion exhibited an ECD of 3.6 μm and an average grain thickness of 0.14 μm, the second emulsion exhibited an ECD of 1.9 μm and an average grain thickness of 0.13 μm, and the third emulsion exhibited an ECD of 1.2 μm and an average thickness of 0.13 μm. The emulsions were spectrally sensitized with anhydro-5,5-dichloro-9-ethyl-3-3-bis-(3-sulfopropyl)oxacarbocyanine hydroxide. Each emulsion layer was coated at a silver coverage of 1.94 g/m$^2$ and a gelatin coverage of 3.12 g/m$^2$. Protective gelatin layers (0.69 g/m$^2$) were coated over the emulsion layers. Each of the gelatin containing layers were hardened with bis(vinylsulfonylmethyl) ether at 0.8 percent of the total gelatin.

IMAGING COMBINATION AND RADIOGRAPHIC EXPOSURE

An imaging assembly having the structure depicted in FIG. 2 was prepared using the screen and radiographic elements described hereinbefore. Contact radiographs were made using a pair of screens on each side of, and in contact with, the radiographic element.

Spherical cellulose acetate beads were used as signals in the test object. These beads had diameters of 1.5 mm, 2.5 mm and 3.0 mm. They were placed upon an aluminum supporting plate having a thickness of 1 mm. A 50 mm thick poly(methyl methacrylate) layer was placed immediately above the test object to introduce an appropriate level of X-radiation scatter.

The test object was exposed to 50 keV X-radiation using a tungsten target (12 degree angle) driven by a three-phase, twelve-pulse generator with 2 mm aluminum equivalent filtration plus Filter F which provided an additional 2 mm aluminum filtration to achieve some slight subject contrast. X-radiation tube focus-to-screen distance was 1.5 m. Filters A–E were substituted at the X-radiation tube collimator exit port for Filter F to make additional exposures.

PROCESSING

The exposed radiographic elements were processed at 35° C. in a commercially available Kodak RP X-Omat (Model 6B) rapid access processor in 90 seconds as follows:

| | |
|---|---|
| development | 24 seconds at 35° C., |
| fixing | 20 seconds at 35° C., |
| washing | 10 seconds at 35° C., and |
| drying | 20 seconds at 65° C., |

where the remaining time was taken up in transport between processing steps. The development step employed the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employed the following fixing composition:

| | |
|---|---|
| Anmonium thiosulfate 60% | 260.0 g |
| Sodium bisulfate | 180.0 g |
| Boric acid | 25.0 g |
| Acetic acid | 10.0 g |
| Aluminum sulfate | 8.0 g |

Water to 1 liter at pH 3.9 to 4.5

RESULTS

The assemblies were exposed to produce an optical density of 1.3 in the signal area (bead area) of the radiographic elements after processing. Upon visual inspection of the resulting radiographs, it was possible to determine the smallest diameter beads which were radiographically detectable. The processed radiographs were examined visually and their contrast ranked according to the visibility of the smallest beads, i.e., the 1.5 mm beads. The results and certain significant test conditions are set forth in the following Table.

TABLE I

| Contrast Rank* | Filter | Tube-Load (mA-s) | Exposure (sec) |
|---|---|---|---|
| 1 | B(Te) | 150 | 1.5 |
| 2 | C(Sb) | 200 | 2.0 |
| 3 | A(Sn) | 200 | 2.0 |
| 4 | D(Cs) | 100 | 1.0 |
| 5 | E(Ba) | 80 | 0.8 |
| 6 | F(Al) | 6.7 | 0.067 |

*1 is highest contrast, 6 is lowest contrast

From an examination of Table I above it is apparent that the imaging combination of this invention, which employs tellurium and antimony-containing filters, is capable of providing radiographs of improved subject contrast at acceptable tube loads and exposure times. The subject contrast produced by tin was significantly lower than that produced by the tellurium or antimony-containing filters. The cesium, barium and aluminum-containing filters were much less effective. To compare contrasts at an optical density of 1.3 it was necessary to restrict exposure times with these materials as compared to the exposure times of the tellurium, antimony and tin-containing filters. This was in itself an indication of the lower effectiveness of cesium, barium and aluminum as filter materials.

STORAGE PHOSPHOR SCREEN EXAMPLES

Filter A'

This filter was constructed similarly as Filter A.

Filter B'

This filter was constructed similarly as Filter B, except that the metal coverage was 228 mg/cm$^2$.

Filter C'

This filter was constructed similarly as Filter C, except that the metal coverage was 228 mg/cm$^2$.

Filter D'

This filter was constructed similarly as Filter D, except that the metal coverage was 239 mg/cm$^2$.

Filter E'

This filter was constructed similarly as Filter E.

Screen

The screen was a conventional storage phosphor screen. It consisted of a europium activated barium fluorobromide phosphor satisfying formula I having a median particle size of 5 μm coated on a black polyester support in a PERMUTHANE polyurethane binder at a total phosphor coverage of 9 g/dm$^2$ at a phosphor to binder ratio of 15:1.

Imaging Combination and Exposure

The imaging combination and exposure were the same as described above in connection with the intensifying screen examples, except that a storage phosphor screen was substituted for the intensifying screen in each instance and no radiographic element was present during screen exposure.

Image Storage

The stored image in the storage phosphor screen was retrieved by scanning with a helium-neon (635 nm) stimulating laser and using a photosensor to record emission. The scanning approach employed is disclosed in Boutet U.S. Pat. No. 5,151,592. A computer was used to correlate scan point emissions with locants for storage and subsequent retrieval.

Radiohraphic Element

The radiographic element employed contained a single red-sensitized silver bromoiodide (2.4 mole percent iodide, based on silver) emulsion layer coated on a blue tinted transparent polyester film support. The emulsion layer was overcoated with a gelatin overcoat containing a poly(methyl methacrylate) bead matting agent. The surface of the support opposite the emulsion layer was coated with a processing solution decolorizable antihalation layer exhibiting as coated a broad absorption peak extending from 630 to 690 nm.

The radiographic element was exposed imagewise with a helium-neon laser using the computer stored image information retrieved from the storage phosphor screen.

Processing

Processing of the imagewise exposed radiographic element was identical to that described in connection with the intensifying screen examples.

Results

The same procedure as described above relating to the intensifying screen example results was employed. The results are summarized in Table II.

TABLE II

| Contrast Rank* | Filter | Tube-Load (mA-s) | Exposure (sec) |
|---|---|---|---|
| 1 | B' (Te) | 300 | 3.0 |
| 2 | C' (Sb) | 400 | 4.0 |
| 3 | A' (Sn) | 400 | 4.0 |
| 4 | D' (Cs) | 200 | 2.0 |
| 5 | E' (Ba) | 160 | 1.6 |
| 6 | F' (Al) | 14 | 0.14 |

*1 is highest contrast, 6 is lowest contrast

By comparing Tables I and II it is apparent the same relative ranking of filter metals was obtained, thereby demonstrating the general applicability of the filter selections to X-radiation imaging screens—that is, both intensifying and storage phosphor intensifying screens.

The invention has been described in detail with particular reference to preferred embodiments thereof, but it will be understood that variations and modifications can be effected within the spirit and scope of the invention.

What is claimed is:

1. An imaging combination for providing improved images of soft tissue anomalies exhibiting subject contrasts of less than 10 percent comprising:

means for providing a source of X-radiation exhibiting a peak emission in the range of from about to 60 keV with a 2 mm aluminum equivalent filtration, a filter for the source radiation capable of being positioned between the source radiation and the soft tissue and containing at least one of tellurium and antimony, an X-radiation imaging screen capable of (a) being positioned to receive X-radiation from the source means after at least a portion of the X-radiation has passed through the soft tissue to thereby provide an image to be detected, (b) absorbing X-radiation, and (c) emitting radiation at a wavelength in the range of about 300 to 700 nm.

2. The imaging combination of claim 1, wherein the imaging screen is a storage phosphor screen that emits radiation at a wavelength in the range of from 300 to 700 nm in response to stimulation following exposure to X-radiation.

3. The imaging combination of claim 2, wherein the imaging screen contains a europium activated barium fluorobromide storage phosphor.

4. The imaging combination of claim 3, wherein the europium activated barium fluorobromide storage phosphor satisfies the formula:

$$BaF_xBr_y{:}Eu_pCa_qNa_r(SiO_2)_s$$

where x is 1.0 to 1.1;

y is 1.0 to 0.9; l p is $7\times10^{-4}$ to $1.3\times10^{-3}$;

q is $1\times10^{-2}$ to $1\times10^{-3}$;

r is $1\times10^{-4}$ to $2\times10^{-3}$; and s is $5\times10^{-3}$ to $5\times10^{-3}$.

5. The imaging combination of claim 1, wherein the imaging screen is an intensifying screen and the combination additionally includes a radiographic element (a) capable of being positioned adjacent the intensifying screen for exposure by the emitted radiation to thereby detect the image from the screen, and (b) comprising a film support and at least one silver halide emulsion layer unit coated on a major face of the support.

6. The imaging combination of claim 5, wherein the radiographic element comprises at least one silver halide emulsion layer unit coated on each major face of the support and the radiographic element is positioned between a pair of intensifying screens.

7. The imaging combination of claim 1, wherein the concentration of tellurium and antimony is in the range of about 25 to 500 mg/cm$^2$.

8. The imaging combination of claim 7, wherein the concentration of tellurium is in the range of about 150 to 250 mg/cm$^2$.

9. The imaging combination of claim 7, wherein the concentration of the antimony in the filter is in the range of about 150 to 250 mg/cm$^2$.

10. The imaging combination of claim 6, wherein each silver halide emulsion layer unit is a spectrally sensitized high tabularity silver halide emulsion layer unit.

11. The imaging combination of claim 10, wherein the radiographic element comprises means positioned between each emulsion layer unit and the support for reducing crossover of the radiation emitted by the screens to less than 10 percent.

12. The imaging combination of claim 11, wherein the silver halide emulsion layer unit coated on one face of the film support exhibits a higher speed and lower average contrast than the silver halide layer unit coated on the other face.

13. The imaging combination of claim 1, wherein the peak emission of the source of X-radiation is in the range of about 45 to 55 keV.

14. The imaging combination of claim 8, wherein the peak emission of the source of X-radiation is in the range of about 48 to 53 keV.

15. The imaging combination of claim 9, wherein the peak emission of the source of X-radiation is in the range of about 48 to 53 keV.

* * * * *